US011598606B2

(12) United States Patent
Strzalko

(10) Patent No.: US 11,598,606 B2
(45) Date of Patent: Mar. 7, 2023

(54) MAGNETIC CONCEALED CARRY POCKET SYSTEM

(71) Applicant: Ryan P. Strzalko, West Bend, WI (US)

(72) Inventor: Ryan P. Strzalko, West Bend, WI (US)

( * ) Notice: Subject to any disclaimer, the term of this patent is extended or adjusted under 35 U.S.C. 154(b) by 95 days.

(21) Appl. No.: 16/947,048

(22) Filed: Jul. 16, 2020

(65) Prior Publication Data

US 2022/0018631 A1 Jan. 20, 2022

(51) Int. Cl.
*F41C 33/02* (2006.01)
*F41C 33/04* (2006.01)

(52) U.S. Cl.
CPC ..... *F41C 33/0218* (2013.01); *F41C 33/048* (2013.01)

(58) Field of Classification Search
CPC .. F41C 33/0218; F41C 33/041; F41C 33/048; F41C 33/0209; A45F 2200/0591
See application file for complete search history.

(56) References Cited

U.S. PATENT DOCUMENTS 2,910,804 A * 11/1959 White ..... F41C 33/041 446/28
9,476,675 B1 * 10/2016 Mangios ..... F42B 39/02
9,557,139 B1 1/2017 Miner et al.
9,777,988 B2 * 10/2017 Karcher ..... F41C 33/048
2005/0217048 A1 * 10/2005 Elie ..... A47K 10/02 15/209.1
2014/0224847 A1 * 8/2014 Miller ..... F41C 33/0263 224/183
2015/0107061 A1 * 4/2015 Stutz ..... H01F 7/0294 24/303
2019/0316875 A1 * 10/2019 Schmadeka ..... A45F 5/02

* cited by examiner

*Primary Examiner* — Corey N Skurdal
(74) *Attorney, Agent, or Firm* — Ziolkowski Patent Solutions Group, SC

(57) ABSTRACT

A magnetic concealed carry pocket system includes a concealed carry pocket coupled to a surface of an object for concealing a firearm and a magnet pouch coupled to the surface of the object and at least partially covered by the concealed carry pocket. The magnetic concealed carry pocket system also includes a magnet sized to fit within the magnet pouch and rated to hold the firearm in position within the concealed carry pocket.

20 Claims, 6 Drawing Sheets

MAGNETIC CONCEALED CARRY POCKET SYSTEM

BACKGROUND OF THE INVENTION

The present invention relates generally to concealed carry pockets and, more particularly, to a concealed carry pocket having a magnet.

Many countries have enacted laws that permit their citizens own firearms for various reasons such as, for example, self-defense and hunting. The laws of some countries also permit their citizens to carry their firearms in public. In carrying a firearm in public, citizens may be subject to open carry laws and/or concealed carry laws. Open carry refers to the practice of openly carrying a firearm in public, and concealed carry refers to the practice of carrying a firearm in public such that a casual observer will not see the firearm. Therefore, the practices of open carry and concealed carry are opposites of each other.

Citizens that desire to carry a firearm in public will choose gear or equipment for carrying the firearm based on whether they are practicing open carry or concealed carry. Citizens practicing open carry will choose equipment that ensures their firearms are visible. On the other hand, citizens practicing concealed carry will choose equipment that keeps their firearms hidden. In either case, citizens will also consider the accessibility and safety of the carrying equipment. Ideally, the equipment will provide quick and easy access to firearms and also adequately secure the firearms such that the firearms are not subject to falling out of the equipment, to theft, or to accidental discharge. However, in practice, equipment for carrying firearms may fall short with respect to at least one of the above-referenced features. This is especially true for equipment meant for practicing concealed carry, as concealing a firearm and providing both accessibility and security for the firearm is a difficult task.

As a non-limiting example of equipment for practicing concealed carry, manufacturers may provide hidden pockets within clothing for the purpose of concealing a firearm. Although these hidden pockets provide some utility, they often suffer from one or more issues. Some hidden pockets are placed in a position that provides security against theft, but is not readily accessible to those wearing the clothing. Other hidden pockets might be easily accessible, but the firearms within those pockets cannot be drawn quickly due to the method of securing the firearm. Still other hidden pockets only allow for firearms to be placed loosely therein such that the firearms are not adequately secured. In that case, the loose firearm could cause discomfort to those who wear the article of clothing or even fall out of the pocket.

It would therefore be desirable to provide a system for practicing concealed carry that provides both strong security for firearms and easy access to firearms.

BRIEF STATEMENT OF THE INVENTION

Embodiments of the present invention provide a magnetic concealed carry pocket system.

In accordance with one aspect of the invention, a magnetic concealed carry pocket system includes a concealed carry pocket coupled to a surface of an object for concealing a firearm, a magnet pouch coupled to the surface of the object and at least partially covered by the concealed carry pocket, and a magnet sized to fit within the magnet pouch and rated to hold the firearm in position within the concealed carry pocket.

In accordance with another aspect of the invention, a kit for a magnetic concealed carry pocket system includes a magnet configured to hold the weight of a firearm when the firearm is magnetically coupled to the magnet, a magnet pouch sized to hold the magnet therein, and a concealed carry pocket sized to cover the magnet pouch and the firearm.

In accordance with yet another aspect of the invention, a magnetic concealed carry pocket system includes a magnet having a holding force sufficient to attract and hold a firearm against a surface thereof and a magnet pouch sized for the magnet to fit therein. The magnet pouch is couplable to a surface of an object. The magnetic concealed carry pocket system further includes a concealed carry pocket having a flap sized to cover at least a portion of the magnet pouch. The concealed carry pocket is couplable to the surface of the object.

Various other features and advantages of the present invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Embodiments of the invention relate to a magnetic concealed carry pocket system. The magnetic concealed carry pocket system includes a concealed carry pocket, a magnet pouch, and a magnet held within the magnet pouch or a holster pocket and a magnetic strip. The concealed carry pocket and holster pockets are sized to hold a firearm. The magnet and the magnet strip are sized and rated to secure the firearm within the concealed carry pocket or the holster pocket while also providing easy access to the firearm.

Figure 1:
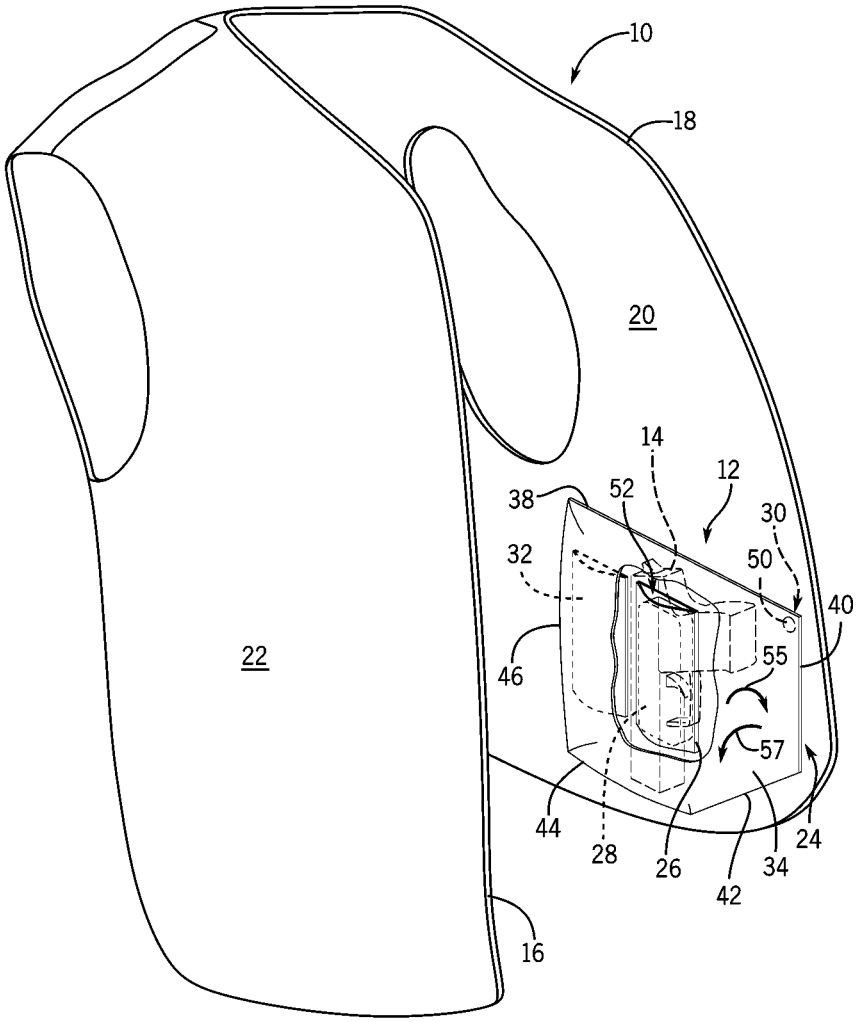
FIG. 1 is a perspective view of an object including a magnetic concealed carry pocket system in a closed position, according to an embodiment of the invention.
Figure 2:
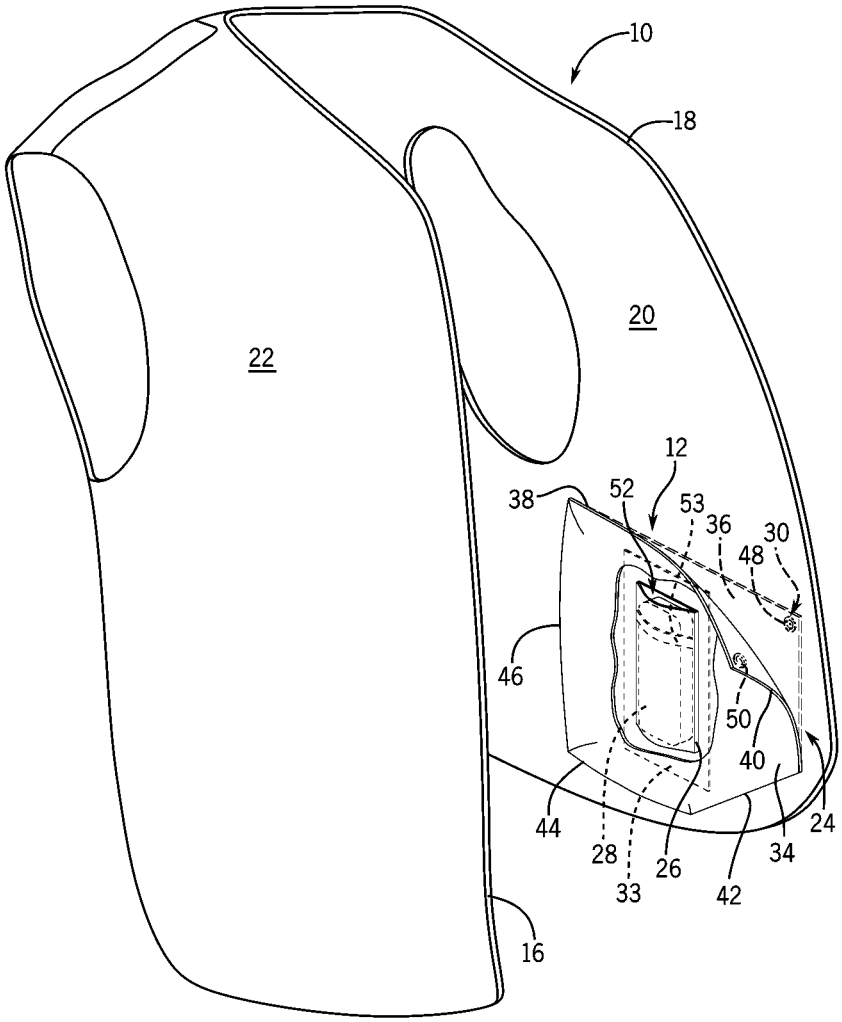
FIG. 2 is a perspective view of the object of FIG. 1 with the magnetic concealed carry pocket system in an open position, according to an object of the invention.

Referring to FIGS. 1-2, perspective views of an object 10 having a magnetic concealed carry pocket system 12 for a firearm 14 are shown, according to an embodiment of the invention. In FIGS. 1-2, object 10 is shown as a vest including a right side 16 and a left side 18 (taken from the perspective of the wearer). However, object 10 may be any number of different objects capable of including magnetic concealed carry pocket system 12. For example, object 10 could be a different wearable object appropriate for concealing a firearm such as, for example, a coat, a jacket, or a sweatshirt. Object 10 could also be an object that is carried rather than worn. Such an object may be in the form of a purse, satchel, backpack, or duffel bag, as non-limiting examples. Furthermore, object 10 could be an object that is neither carried nor worn such as, by way of example, a vehicle or a stroller. In other words, object 10 could be any article of manufacture that is capable of including magnetic concealed carry pocket system 12.

In FIGS. 1-2, magnetic concealed carry pocket system 12 is coupled to an interior surface 20 of left side 18 of vest 10, but could be coupled to an exterior surface (not shown) of left side 18 of vest 10 as well. Further, while magnetic concealed carry pocket system 12 is shown as being coupled to left side 18 of vest 10 for use by a right-handed individual, magnetic concealed carry pocket system 12 could alternatively or additionally be coupled to an interior surface (not shown) or exterior surface 22 of right side 16 of vest 10 for use by a left-handed individual. The placement of magnetic concealed carry pocket system 12 is only limited by its size and the size of the object on which it is placed. Thus, a user may place magnetic concealed carry pocket system 12 on a relevant object where it is most convenient, usually taking into account the shape of the object and the security for and accessibility to firearm 14.

Magnetic concealed carry pocket system 12 includes a concealed carry pocket 24, a magnet pouch 26, and a magnet 28 held within magnet pouch 26. Magnetic concealed carry pocket system 12 may also contain other optional features within concealed carry pocket 24, as desired. As a non-limiting example, magnetic concealed carry pocket system 12 may include an optional closure system 30 for selectively holding concealed carry pocket 24 a closed position shown in FIG. 1 and releasing concealed carry pocket 24 into an open position shown in FIG. 2. As another non-limiting example, magnetic concealed carry pocket system 12 may include an optional pouch 32 for extra ammunition for firearm 14, as shown in FIG. 1. As yet another non-limiting example, magnetic concealed carry pocket system 12 may include a magnetic shield 33, as shown in FIG. 2. The availability of optional features within concealed carry pocket 24 may depend on the size of magnetic concealed carry pocket system 12 and the size of firearm 14. Alternatively, magnetic concealed carry pocket system 12 may include the optional features outside of concealed carry pocket 24.

Generally, concealed carry pocket 24 is sized for a small to medium firearm that is more readily transportable and, therefore, concealable than larger firearms. However, the size of concealed carry pocket 24 may vary based on the size and type of object on which it is positioned and/or based on the preference of its user. In FIGS. 1-2, concealed carry pocket 24 includes a flap 34 positioned on interior surface 20 of left side 18 of vest 10. Flap 34 may include stretchable and/or non-stretchable material. In various embodiments, flap 34 may not be present when magnetic concealed carry pocket system 12 is in such a position that is already in a concealed area of vest 10. Whether flap 34 is included may depend on the preference of the user. In some embodiments, flap 34 is coupled directly to interior surface 20 of left side 18 of vest 10. However, FIG. 2 illustrates that concealed carry pocket 24 may include an optional liner 36 coupled to interior surface 20. In that case, flap 34 would be coupled to interior surface 20 via liner 36.

Flap 34 is shown in FIGS. 1-2 as a five-sided shape having a top edge 38, a right edge 40, an angled edge 42, a bottom edge 44, and a left edge 46, but may be provided in a number of different configurations such as, for example, a six-sided pocket, a square or rectangular four-sided pocket, or a circular pocket. Flap 34 is configured to transition concealed carry pocket 24 between the closed position shown in FIG. 1 where all edges 38, 40, 42, 44, 46 of flap 34 are adjacent to interior surface 20 and/or liner 36 and the open position where at least a portion of at least one edge 38, 40, 42, 44, 46 of flap 34 is spaced apart from interior surface 20 and/or liner 36. FIGS. 1-2 illustrate that angled, bottom, and left edges 42, 44, 46 of flap 34 are attached edges that are coupled to interior surface 20 and/or liner 36 and top and right edges 38, 40 of flap 34 are free edges that are able to move away from interior surface 20 and/or liner 36. However, more or less edges of flap 34 may be coupled to interior surface 20 and/or liner 36.

As one non-limiting example, flap 34 could be configured such that its right, angled, bottom, and left edges 40, 42, 44, 46 are attached edges and only its top edge 38 is a free edge. As another non-limiting example flap 34 could be configured such that its bottom and left edges 44, 46 are attached edges and its top, right, and angled edges 38, 40, 42 are free edges. Edges 38, 40, 42, 44, 46 of flap 34 may be coupled to interior surface 20 and/or liner 36, and liner 36 may be coupled to interior surface 20 using a number of different methods such as, for example, sewing, hook and loop fasteners, magnets, buttons, snaps, or zippers, depending whether they are designed to remain on interior surface 20 and/or liner 36 or whether they are designed to be detachable from interior surface 20 and/or liner 36. Various components of concealed carry pocket 24 may be detachable so that they may be transferred between different objects.

As noted above, magnetic concealed carry pocket system 12 may also optionally include closure system 30 and magnetic shield 33. Closure system 30 is configured keep concealed carry pocket 24 in the closed position with the free edges of flap 34 (top and right edges 38, 40 in FIGS. 1-2) adjacent to interior surface 20 or liner 36. In FIGS. 1-2, optional closure system 30 is shown as a snap system 30 having a stud component 48 coupled to or embedded in interior surface 20 and/or liner 36 and a socket component 50 coupled to or embedded in flap 34. However, the placement of stud and socket components 48, 50 may be reversed, as desired. Further, optional closure system 30 may be in a variety of different forms such as, for example, a button-hole arrangement, hook and loop fasteners, or magnets, as will be discussed in more detail below with respect to FIGS. 6-7.

Optional magnetic shield 33 is shown in FIG. 2. Magnetic shield 33 is generally made of ferromagnetic material and may be in the form of a ferromagnetic plate 33 like that shown in FIG. 2, as a non-limiting example. Magnetic shield 33 may be positioned on or embedded in interior surface 20 and/or liner 36. Magnetic shield 33 may also be sized to fit within magnetic pocket 26 where it would be magnetically coupled to magnet 28. The purpose of magnetic shield 33 is to redirect at least a portion of the magnetic field of magnet 28 in order to prevent objects from coupling to magnet 28 opposite firearm 14. For example, if vest 10 were to include a pocket (not shown) positioned on the exterior surface of left side 18 of vest 10 and aligned with concealed carry pocket 24 and a user were to place a metal object (not shown) like a set of keys into the pocket, magnetic shield 33 would aid in preventing the metal object from magnetically coupling to magnet 28, as such magnetic coupling may be a nuisance to the user.

Within concealed carry pocket 24, magnet 28 is sized to fit through an opening 52 in magnet pouch 26 so that a user can easily insert and remove magnet 28. In FIGS. 1-2, opening 52 is facing top edge 38 of flap 34. However, in various embodiments, magnet pouch 26 may have different configuration in which opening 52 is facing right edge 40, bottom edge 44, or left edge 46 of flap 34. Positioning magnet pouch 26 such that opening 52 is these alternative positions may aid in preventing magnet 28 from being pulled output of magnet pouch 26 when a user is removing firearm 14 from magnetic concealed carry pocket system 12.

In addition, while magnet pouch 26 and magnet 28 are positioned on interior surface 20 of left side 18 of vest 10 and/or liner 36 behind flap 34 in FIGS. 1-2, magnet pouch 26 and magnet 28 may be positioned on the exterior surface of left side 18 of vest 10 in some embodiments. In that case, concealed carry pocket 24 may include a separate covering for magnet pouch 26 and magnet 28, such as, for example, a second flap (not shown), and/or a second liner (not shown) on the exterior surface of left side 18 of vest 10 for concealing magnet pouch 26 and magnet 28. Furthermore, in some embodiments, magnet pouch 26 optionally includes at least one securing device, such as, for example, an elastic band, a zipper, a button, a hook and loop fastener, or a separate magnet, in order to better secure magnet 28 within magnet pouch 26. FIG. 2 illustrates a non-limiting example of a securing device in the form of an elastic band 53 extending around a cross-section of magnet pouch 26. Alternatively or in addition to a securing device, magnet pouch 26 itself may be formed of a stretchable material that aids in holding magnet 28 therein.

A user may desire that magnet 28 be removable in order to more easily clean magnetic concealed carry pocket system 12 and the object on which it is placed. As a non-limiting example, when vest 10 needs cleaning, a user can simply remove magnet 28 from magnet pouch 26, wash vest 10, and reinsert magnet 28 in magnet pouch 26 before wearing vest 10 again. A user may also want to remove magnet 28 when the user is not carrying a firearm such as, for example, when passing through security at an airport. In some embodiments, however, magnet pouch 26 may be sealed so that magnet 28 is not readily removable and may even be embedded within the object on which magnetic concealed carry pocket system 12 is used. As a non-limiting example, magnet 28 and magnet pouch 26 may be embedded within the lining of vest 10. Whether magnet 28 is removable from magnet pouch 26 may depend on the type and size of the object on which magnetic concealed carry pocket system 12 is used and the preference of its user.

In any case, magnet 28 is sized and rated to secure firearm 14 within concealed carry pocket 24. That is, magnet 28 has a large enough pull or holding force to attract and hold firearm 14 to itself when firearm 14 is placed into concealed carry pocket 24. In the embodiments shown in FIGS. 1-2, magnet 28 in the form of a strong permanent magnet or, more specifically, a rare-earth magnet, such as, for example, a neodymium or samarium-cobalt magnet, in order to keep the size of magnet 28 smaller. However, magnet 28 may have a variety of configurations, as explained in more detail below.

The required holding force of magnet 28 will depend on the size/type of firearm 14, which may include full size, compact, sub compact, and micro pistol handguns, as non-limiting examples. If firearm 14 is a smaller firearm such as, for example, a micro pistol handgun, the holding force of magnet 28 may be 5 pounds or less. When firearm 14 is one of the heavier types, magnet 28 may require a stronger holding force such as, for example, 10-20 pounds. In other words, the necessary holding force rating of magnet 28 will depend, at least in part, on the type of firearm 14. The user may also select a weaker or strong magnet 28 depending on personal preferences and abilities such as, for example, the user's strength.

Regardless of the exact configuration of magnet 28, when firearm 14 is coupled to magnet 28 in the manner shown in FIG. 1, the holding force of magnet 28 will prevent firearm 14 from moving significantly within or falling out of concealed carry pocket 24. Firearm 14 may spin or rotate on magnet 28 slightly due to incidental or accidental contact, such as, for example, when a user brushes against firearm 14 while reaching for another item, but firearm 14 will not rotate significantly on magnet 28 without much more forceful contact such as, for example, a hard fall to the ground. The dimensions of concealed carry pocket 24 may also hinder significant rotation of firearm 14 in some embodiments. Further, even if firearm 14 does rotate on magnet 28, a user is able to put firearm 14 back into a position in which the holding force of magnet 28 on firearm 14 is at its strongest once again—namely, a position in which the most surface area of magnet 28 is magnetically coupled to firearm 14.

However, firearm 14 will not fall out of concealed carry pocket 24 due to accidental contact except in the rarest of circumstances. Firearm 14 would not only have to be subject to a force in the right direction and strength to overcome the holding force of magnet 28, but would also have to escape from concealed carry pocket 24 before firearm 14 recouples to magnet 28. In other words, even if firearm 14 were to briefly uncouple from magnet 28, firearm 14 will almost immediately recouple to magnet 28 due to pressure from flap 34 of concealed carry pocket 24, particularly when flap 34 is held in the closed position with closure system 30.

Furthermore, magnet 28 may also hinder theft of firearm 14 from within concealed carry pocket 24. In order to pull firearm 14 straight off of magnet 28, a thief would have to exert a significant force on firearm 14 that the thief would be unlikely to achieve without extreme effort. As such, where a thief is unaware that firearm 14 is magnetically coupled to magnet 28, the thief will not be ready to exert the force necessary to pull firearm 14 straight off of magnet 28 or to use the recommended method of removing firearm 14 from magnet 28, as described in more detail below. Thus, magnet 28 provides security against unwanted removal of firearm 14 from within concealed carry pocket 24.

While the holding force of magnet 28 provides security against undesired removal of firearm 14 from concealed carry pocket 24, the holding force of magnet 28 is not so strong so as to greatly hinder a user who is an owner of magnetic concealed carry pocket system 12 and who wishes to intentionally remove firearm 14 from within concealed carry pocket 24. When such a user wishes to uncouple firearm 14 from magnet 28, the user may apply a deliberate twisting or dual-rotational motion to firearm 14 to de-couple firearm 14 from magnet 28. More specifically, a user may move firearm 14 in a first rotational direction, such as, for example, rotational direction 55 shown in FIG. 1, by spinning firearm 14 on magnet 28 and also move firearm 14 in a second rotational direction, such as, for example, rotational direction 57 shown in FIG. 1, in order that firearm 14 de-couples from magnet 28. Alternatively, a user may move firearm 14 in a first rotational direction that is perpendicular to rotational direction 55 by rocking firearm 14 on magnet 28 in order to create an angle of separation between firearm 14 and magnet 28. Further, a user may move firearm 14 in a second rotational direction that is the opposite of rotational direction 57. However, the first and second rotational directions described above are only examples, and many variations are possible.

The key is to move firearm 14 in a first rotational direction such that less surface area of firearm 14 is magnetically coupled to magnet 28 either before or simultaneously with moving firearm 14 in a second rotational direction in order to completely de-couple firearm 14 from magnet 28. Application of such twisting or dual-rotational motions will be aided by the user holding onto object 10 while performing the motion. Regardless of exactly how a user performs the twisting or dual-rotational motion, the motion is relatively easy for a user to perform either as one continuous motion or two separate steps and is not likely to occur on accident or be utilized by a thief who is not aware of the presence of magnet 28. Hence, in addition to security, the holding force of magnet 28 provides easy access to firearm 14.

Figure 3B:
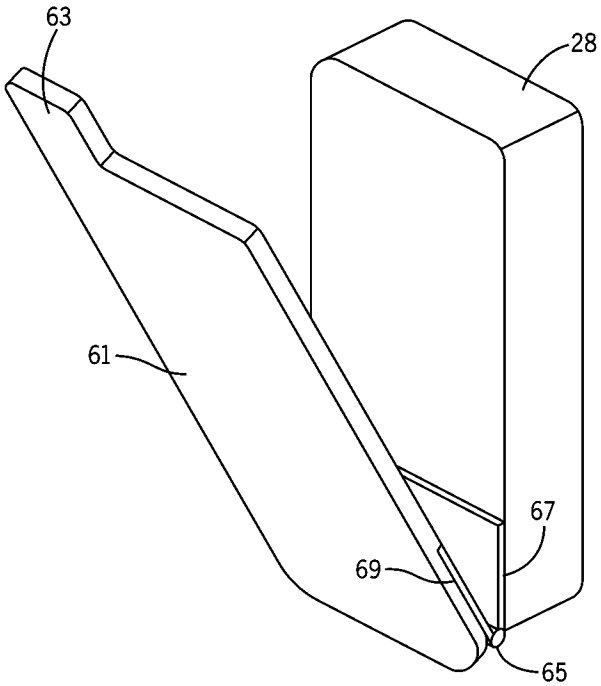
FIGS. 3A-3B are perspective views of the magnet shown in FIGS. 1-2 with a break plate coupled thereto, according to an embodiment of the invention.
Figure 3A:
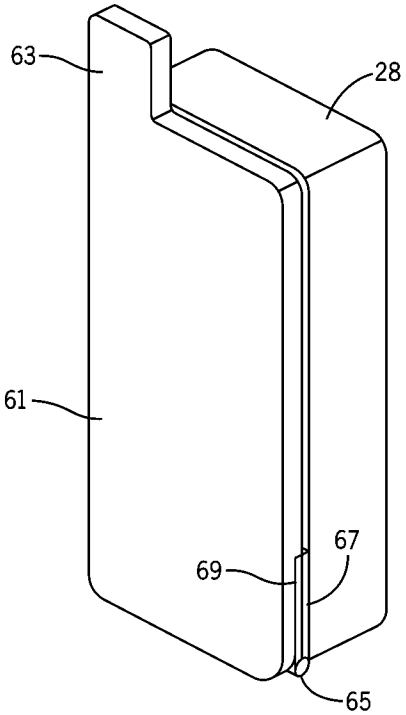

Besides facilitating the de-coupling of firearm 14 from magnet 28 via the twisting or dual-rotational motion, magnetic concealed carry pocket system 12 may include additional components that aid in de-coupling firearm 14 from magnet 28. A non-limiting example of such components is shown in FIGS. 3A-3B, which are perspective views of magnet 28 of FIGS. 1-2 coupled to a break plate 61, according to an embodiment of the invention. FIG. 3A illustrates break plate 61 adjacent to magnet 28, and FIG. 3B illustrates break plate 61 separated from magnet 28. Break plate 61 includes a tab 63 and is coupled to magnet 28 via a hinge 65. Hinge 65 includes a first hinge plate 67 coupled to magnet 28 and a second hinge plate 69 coupled to break plate 61 such that break plate 61 may rotate away from and toward magnet 28. First and second hinge plates 67, 69 may be coupled to magnet 28 and break plate 61 by a variety of means such as, for example, an adhesive, hook and loop fasteners, or bolts. Break plate 61 may be formed of a ferromagnetic material such that it may magnetically couple to magnet 28. Break plate 61 may alternatively be formed of a non-ferromagnetic material that will not magnetically couple to magnet 28, such as, for example, plastic, in order to minimize any magnetic shielding effects that would weaken the holding force of magnet 28 on firearm 14.

The purpose of break plate 61 is to provide another method by which a user may de-couple firearm 14 from magnet 28. When brake plate 61 is used with magnet 28, magnet pocket 26 is typically (but not necessarily) oriented such that opening 52 is facing bottom edge 44 of flap 34 of concealed carry pocket 24. Magnet 28 is positioned within magnetic pocket 26, and break plate 61 is positioned outside of magnetic pocket 26. When break plate 28 is included with magnet 28, a user may de-couple firearm 14 from magnet 28 by using his or her index finger to pull tab 63 of break plate 61 away from magnet 28 while simultaneously using his or her remaining fingers and thumb to exert a force on firearm 14 directly. Pulling on tab 63 focuses the force of the user at the periphery of magnet 28 to provide more leverage.

As set forth above, magnet 28 is shown in FIGS. 1-3B as a single permanent magnet having a substantially rectangular shape with rounded corners. However, magnet 28 may have a variety of configurations with different sizes, shapes, and components in various embodiments of magnetic concealed carry pocket system 12. As a non-limiting example, magnet 28 may include a switching component (not shown) that can switch magnet 28 from an ON state in which it is magnetized to attract and hold firearm 14 and an OFF state in which it is de-magnetized. Where magnet 28 is switchable between the ON and OFF states, magnet 28 may be rated with a higher holding force. That is, magnet 28 may be configured to prevent any removal of firearm 14 when magnet 28 is in the ON state or at least removal by human strength alone. In that case, magnet 28 must be switched to the OFF state in order to remove firearm 14. However, regardless of the rating of magnet 28, switching magnet 28 to the OFF state will allow for easier storage of magnet 28 among objects with magnetic materials.

In some embodiments where magnet 28 is switchable between the ON and OFF states, magnet 28 includes a switching component (not shown) as a toggle, lever, knob, or similar device that rotates a portion of magnet 28 or is a rotatable portion of magnet 28. When moving the switching component to the OFF state, the magnetic field produced by magnet 28 collapses within the rotated portion of magnet 28. While magnet 28 may still emit a minimal magnetic field, magnet 28 is effectively de-magnetized such that the attractive force of magnet 28 drops well below a level capable of securing firearm 14 within concealed carry pocket 24. Thus, a user may use the switching component to selectively switch magnet 28 from the ON state to secure firearm 14 within concealed carry pocket 24 and the OFF state to release firearm 14 from within concealed carry pocket 24.

Furthermore, magnet 28 may be switchable between the ON and OFF states when in the form of a battery-powered electromagnet (not shown) including a coil (not shown) wound around a core (not shown). In that case, magnet 28 may be powered by its own battery or may receive power from a battery that is a component of a larger system included in the object with which magnet 28 is utilized. As a non-limiting example, if magnet 28 is utilized within a jacket with a battery-powered heating system, the battery of the heating system may also power magnet 28. As an electromagnet, magnet 28 may transition between the ON state and the OFF state by selectively supplying and shutting off current to its coil using a switching component (not shown) such as, for example, a toggle, button, lever, or knob. That is, the electromagnet coil receives current in the ON state and does not receive current in the OFF state. Such a configuration may additionally allow for adjusting or varying the holding force of magnet 28 by adjusting or varying how much current is applied to the coil. The adjustment function may be performed using a separate switching component or dial on magnet 28 or may be incorporated into the same switching component that transitions magnet 28 between the ON state and the OFF state.

As an alternative or in addition to the switching component used when magnet 28 is an electromagnet, magnet 28 may be switched to the OFF state by a radio-frequency identification (hereinafter "RFID") fob (not shown) carried by the user. The RFID fob may be realized in a variety of different forms including, but not limited to, a ring, bracelet, bracelet charm, watch, or armband that is on the user's hand, wrist, or arm. The RFID fob may also be a non-wearable object, such as, for example, a keychain, but such an object will likely provide less convenience. One of magnet 28 and the RFID fob will have a tag that includes unique identifying information and the other will have a reader that gathers the information from the tag. In either case, when the tag is within a specific distance of the reader and the reader confirms the presence of the tag, magnet 28 will switch to the OFF state. The distance between the reader and the tag that will switch magnet 28 to the OFF state is generally set to a short distance, such as, for example, between two and six inches, in order to prevent an accidental release of firearm 14.

Figure 4A:
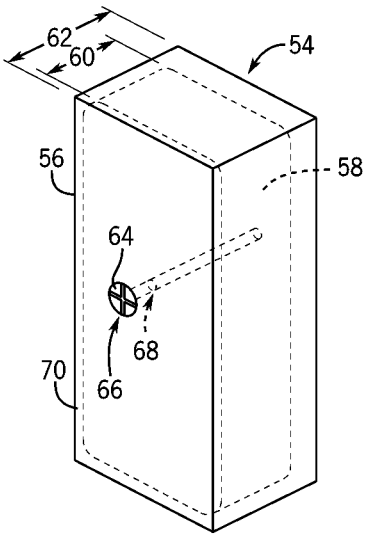
FIGS. 4A-4B are perspective views of an adjustable magnet system, according to an embodiment of the invention.
Figure 4B:
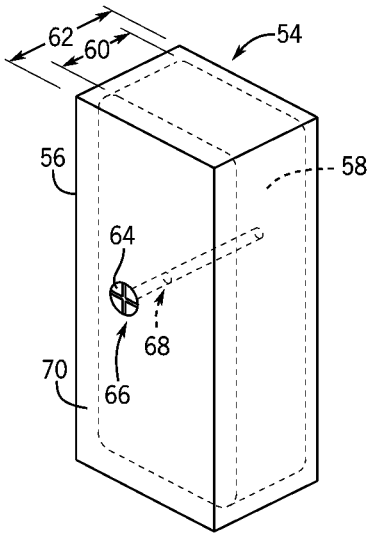

Other configurations of magnet 28 may also provide the capability of adjusting the holding force of magnet 28. Non-limiting examples of such configurations are illustrated in FIGS. 4A-4B and 5A-5B. Referring now to FIGS. 4A-4B, perspective views of an adjustable or variable magnet system 54 are shown, according to an embodiment of the invention. Adjustable magnet system 54 may be used as magnet 28 in magnetic concealed carry pocket system 12 of FIGS. 1-2. Adjustable magnet system 54 includes a case 56 with a magnet 58 positioned therein. Magnet 58 has a thickness 60 that is smaller than a thickness 62 of case 56. A fastener 64 extends through an opening 66 in case 56 and an opening 68 in magnet 58. Magnet 58 can be moved within case 56 by rotating fastener 64.

FIG. 4A shows magnet 58 in a first position within case 56, and FIG. 4B shows magnet 58 in a second position within case 56. By adjusting where magnet 58 is positioned within case 56, a user can adjust how much holding force magnet 58 supplies at a sidewall 70 of case 56. If magnet 58 is positioned within case 56 immediately adjacent to sidewall 70, magnet 58 may supply essentially the same holding force on a firearm (not shown in FIGS. 4A-4B) as magnet 28 shown in FIGS. 1-2. As magnet 58 moves farther away from sidewall 70, magnet 58 will not supply as much holding force on a firearm because magnet 58 will be farther away from the firearm. As such, a user may utilize adjustable magnet system 54 to vary the holding force supplied to a firearm based on the size of the firearm or strength of the user. That is, a user may place firearms having different weights within magnetic concealed carry pocket system 12 and may want to adjust how much holding force is supplied to the firearms to provide additional security to the firearm within magnetic concealed carry pocket system 12 or to make it easier to remove the firearm from magnetic concealed carry pocket system 12.

Figure 5A:
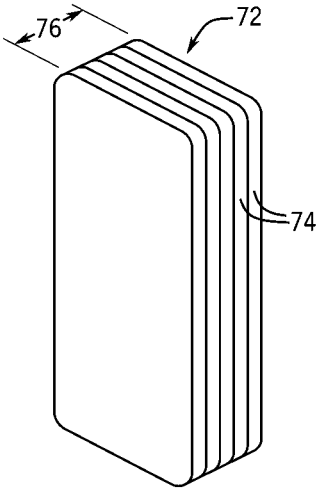
FIGS. 5A-5B are perspective views of an adjustable magnet system, according to an embodiment of the invention.
Figure 5B:
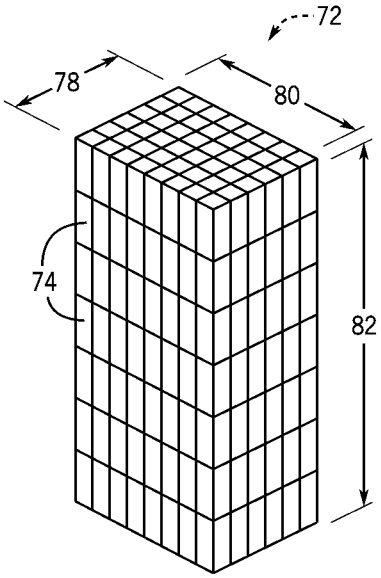

Referring now to FIGS. 5A-5B, perspective views of an adjustable or variable magnet system 72 are shown, according to an embodiment of the invention. Adjustable magnet system 72 may be used in place of magnet 28 in magnetic concealed carry pocket system 12 of FIGS. 1-2. Adjustable magnet system 72 includes multiple magnet sections 74 that are magnetically coupled together. FIG. 5A illustrates adjustable magnet system 72 with five magnet sections 74 positioned along a thickness 76 of adjustable magnet system 72 with a substantially rectangular shape with rounded corners. FIG. 5B illustrates adjustable magnet system 72 with a larger number of smaller magnet sections 74 positioned along a thickness 78, width 80, and length 82 of adjustable magnet system 72 with a rectangular shape. However, magnet sections 74 should not be limited to the size, shape, or number of sections shown in FIGS. 5A-5B. Adjustable magnet system 72 may optionally include a case (not shown in FIGS. 5A-5B) that prevents excessive shifting of magnet sections 74, but that provides access to magnet sections 74 via an opening that may be immediately accessible or accessible by means of a lid, a cover, or another component with a similar function.

Regardless of the size, shape, or number of magnet sections 74, a user may add or remove magnet sections 74 in order to increase or decrease the overall strength and/or area of the holding force of adjustable magnet system 72, depending on the configuration of magnet sections 74. That is, as a user adds magnet sections 74 to adjustable magnet system 72, the overall strength and/or area of the holding force of adjustable magnet system 72 will increase. Conversely, if a user removes magnet sections 74 from adjustable magnet system 72, the overall strength and/or area of the holding force of adjustable magnet system 72 will decrease. A user may wish to increase or decrease the overall strength and/or area of the holding force of adjustable magnet system 72 for the same or similar reasons discussed above with respect to the holding force of adjustable magnet system 54 of FIGS. 4A-4B.

Figure 7:
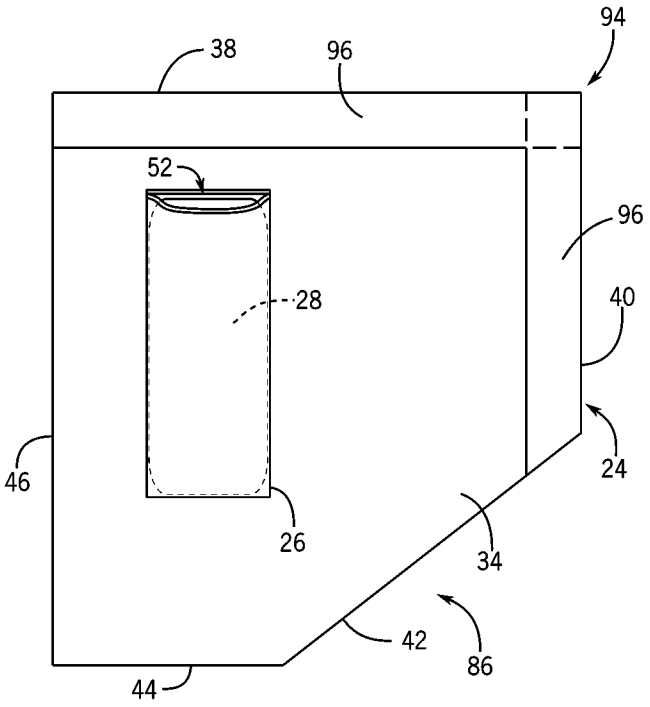
FIG. 7 is a front view of a magnetic concealed carry pocket system, according to an embodiment of the invention.
Figure 6:
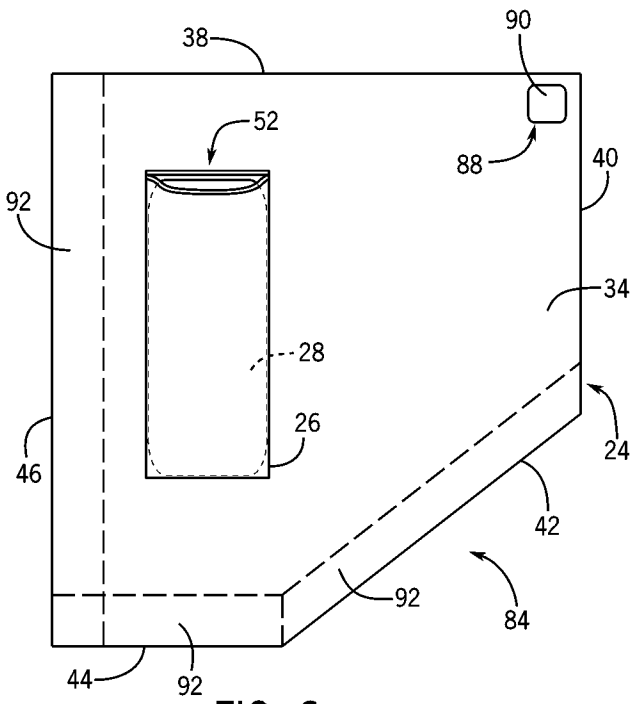
FIG. 6 is a front view of a magnetic concealed carry pocket system, according to an embodiment of the invention.

Referring now to FIGS. 6-7, front views of magnetic concealed carry pocket systems 84, 86 are shown, according to embodiments of the invention. Magnetic concealed carry pocket systems 84, 86 are arranged similarly to magnetic concealed carry pocket system 12 of FIGS. 1-2—and, thus, like elements therein are numbered identical to corresponding elements in magnetic concealed carry pocket system 12—except that alternative attachment and closing features to those of magnetic concealed carry pocket system 12. Magnetic concealed carry pocket systems 84, 86 may replace magnetic concealed carry pocket system 12 in FIGS. 1-2.

Referring to FIG. 6, magnetic concealed carry pocket system 84 includes concealed carry pocket 24 having flap 34, magnet pouch 26, and magnet 28 held within magnet pouch 26 in a manner similar to that of magnetic concealed carry pocket system 12 of FIGS. 1-2. Further, magnetic concealed carry pocket system 84 may include optional liner 36 (not shown in FIG. 6). Magnetic concealed carry pocket system 84 also includes a closure system 88 that is configured to hold concealed carry pocket 24 in the closed position. Closure system 88 includes a first magnet 90 coupled to or embedded in flap 34 and a second magnet (not shown in FIG. 6) that will be coupled to or embedded in an object (not shown in FIG. 6) and/or liner 36. First magnet 90 and the second magnet are configured to magnetically couple to each other when flap 34 is adjacent to an object and/or liner 36 in order to keep flap 34 adjacent to the object and/or liner 36.

Magnetic concealed carry pocket system 84 may also include optional fastening strips 92 formed of one or more releasable fasteners, such as, for example, hook and loop fasteners or magnets, coupled to or embedded in the attached edges of flap 34 of concealed carry pocket 24. However, fastening strips 92 may be formed of a single fastening strip 92 in some embodiments. In FIG. 6, angled, bottom, and left edges 42, 44, 46 are configured attached edges, but this may vary, as explained above with respect to magnetic concealed carry pocket system 12 of FIGS. 1-2. Where magnetic concealed carry pocket system 84 includes fastening strips 92 on flap 34, corresponding fastening strips 92 will be placed on the object to which flap 34 will be attached and/or on liner 36. In some embodiments, flap 34 is completely detachable from the object and/or liner 36.

Alternatively, fastening strips 92 could be placed on all the edges of liner 36 and the object to which liner 36 is attached such that the entirety of magnetic concealed carry pocket system 84 is detachable from the object. In addition, the pairs of fastening strips 92 applied to flap 34, liner 36, and/or an object could be in the form of one or more other types of releasable fasteners, such as, for example, zippers, snaps, or buttons, that allow flap 34 and/or magnetic concealed carry pocket system 84 to be detachable. Regardless, where flap 34 or magnetic concealed carry pocket system 84 is detachable, a user will be able transfer flap 34 or magnetic concealed carry pocket system 84 between different objects and clean flap 34 or magnetic concealed carry pocket system 84 separately from the object. Magnet pouch 26 may also be separately detachable from an object and/or liner 36 using one or more of the releasable fasteners described above.

Referring now to FIG. 7, magnetic concealed carry pocket system 86 includes concealed carry pocket 24 having flap 34, magnet pouch 26, and magnet 28 held within magnet pouch 26 in a manner similar to that of magnetic concealed carry pocket system 12 of FIGS. 1-2 and magnetic concealed carry pocket system 84 of FIG. 6. Magnetic concealed carry pocket system 86 may additionally include optional liner 36 (not shown in FIG. 7). Furthermore, magnetic concealed carry pocket 86 includes a closure system 94 that is configured to hold concealed carry pocket 24 in the closed position. Closure system 94 includes a plurality of magnetic strips 96. However, in some embodiments, magnetic strips 96 may be formed of a single magnetic strip 96 and/or may be formed of one or more other types releasable fasteners such as, for example, hook and loop fasteners. At least one magnetic strip 96 is coupled to or embedded in the free edges of flap 34 of concealed carry pocket 24, and each of those magnetic strips 96 will have a corresponding magnetic strip 96 coupled to or embedded in an object (not shown) and/or liner 36. In FIG. 7, top and right edges 38, 40 are free edges, but concealed carry pocket 24 may be configured differently in various embodiments, as explained above with respect to magnetic concealed carry pocket system of FIGS. 1-2. In any event, magnetic strips 96 on flap 34 and magnetic strips 96 on the object and/or liner 36 are configured to magnetically couple to each other when flap 34 is adjacent to the object and/or liner 36 in order to keep flap 34 adjacent to the object and/or liner 36.

While the above features of magnetic concealed carry pocket system 12 of FIGS. 1-2, magnetic concealed carry pocket system 84 of FIG. 6, and magnetic concealed carry pocket system 86 of FIG. 7 are shown separately, the features of magnetic concealed carry pocket systems 12, 84, 86 may be combined. As a non-limiting example, fastening strips 92 of magnetic concealed carry pocket system 84 may be incorporated into magnetic concealed carry pocket system 12 and/or magnetic concealed carry pocket system 86. As another non-limiting example, closure system 94 of magnetic concealed carry pocket system 86 may be incorporated into magnetic concealed carry pocket system 12 and/or magnetic concealed carry pocket system 84. Accordingly, the features of magnetic concealed carry pocket systems 12, 84, 86 are readily exchangeable and customizable by a user. Thus, a user can utilize the features of magnetic concealed carry pocket systems 12, 84, 86 based on need.

Figure 8:
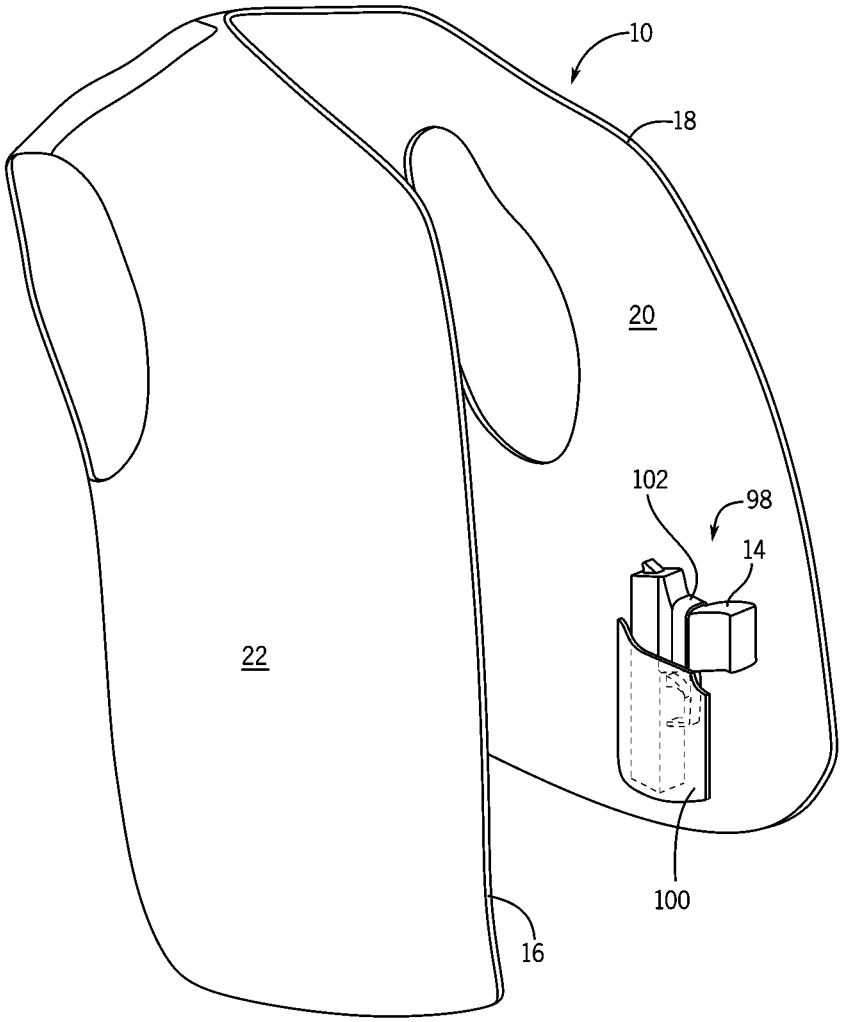
FIG. 8 is a perspective view of the object shown in FIGS. 1-2 with a magnetic concealed carry pocket system, according to an embodiment of the invention.

Referring now to FIG. 8, a perspective view of object 10 of FIGS. 1-2 having a magnetic concealed carry pocket system 98 for a firearm 14 is shown, according an embodiment of the invention. Similar to magnetic concealed carry pocket system 12 of FIGS. 1-2, the position of magnetic concealed carry pocket system 98 is not limited to the interior surface 20 of left side 18 of object 10, but may be placed on object 10 at the preference of the user. Magnetic concealed carry pocket system 98 includes a holster pocket 100 and a magnetic strip 102 for securing firearm 14 within holster pocket 100. In addition, magnetic concealed carry pocket system 98 may optionally include concealed carry pocket 24 of magnetic concealed carry pocket systems 12, 84, 86 including optional liner 36.

Magnetic strip 102 is partially coupled to and/or embedded in object 10 and/or liner 36. When a user places firearm 14 within holster pocket 100, the user may then wrap magnetic strip 102 around firearm 14 in order to magnetically couple magnetic strip 102 to firearm 14, as shown in FIG. 8. While magnetic strip 102 is wrapped around firearm 14, magnetic strip 102 magnetically couples to three different sides of firearm 14 and, therefore, provides, security to firearm 14 from multiple angles. In order to remove firearm 14 from holster pocket 100, the user must simply unwrap magnetic strip 102 from around firearm 14. Since magnetic strip 102 is thinner than magnet 28 of magnetic concealed carry pocket system 12 of FIGS. 1-2, it will be easier for a user to release magnetic strip 102 from firearm 14.

Beneficially, embodiments of the invention thus provide a magnetic concealed carry pocket system that may be used to secure a firearm on a variety of different objects. The magnetic concealed carry pocket system includes a concealed carry pocket, a magnet pouch, and a magnet positioned within the magnet pouch. Alternatively, the magnetic concealed carry pocket system may include a holster pocket and a magnetic strip. When a user places a firearm within concealed carry pocket or holster pocket, the firearm will magnetically couple to the magnet or the magnetic strip to secure the firearm against accidental contact and theft. A user may intentionally remove the firearm from the magnet by performing a simple twisting or dual-rotational motion and/or using a break plate or from the magnetic strip by simply unwrapping the magnetic strip from the firearm. Hence, the magnet or the magnetic strip will secure the firearm within the concealed carry pocket or the holster pocket while simultaneously providing easy access to the firearm. In addition, the magnetic concealed carry pocket system may include a variety of optional features that allow a user to customize the magnetic concealed carry pocket system. As non-limiting examples, the magnetic concealed carry pocket system may include a magnet switchable between an ON state in which the magnet is magnetized and an OFF state in which the magnet is de-magnetized; an adjustable magnet system that allows a user to adjust the holding force applied to a firearm; a concealed carry pocket system that is detachable from an object or has detachable components; and closure systems that releasably hold the concealed carry pocket in a closed position on an object. Such features may increase the security to the firearm with the concealed carry pocket and/or provide additional convenience to a user.

According to one embodiment of the present invention, a magnetic concealed carry pocket system includes a concealed carry pocket coupled to a surface of an object for concealing a firearm, a magnet pouch coupled to the surface of the object and at least partially covered by the concealed carry pocket, and a magnet sized to fit within the magnet pouch and rated to hold the firearm in position within the concealed carry pocket.

According to another embodiment of the present invention, a kit for a magnetic concealed carry pocket system includes a magnet configured to hold the weight of a firearm when the firearm is magnetically coupled to the magnet, a magnet pouch sized to hold the magnet therein, and a concealed carry pocket sized to cover the magnet pouch and the firearm.

According to yet another embodiment of the present invention, a magnetic concealed carry pocket system includes a magnet having a holding force sufficient to attract and hold a firearm against a surface thereof and a magnet pouch sized for the magnet to fit therein. The magnet pouch is couplable to a surface of an object. The magnetic concealed carry pocket system further includes a concealed carry pocket having a flap sized to cover at least a portion of the magnet pouch. The concealed carry pocket is couplable to the surface of the object.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A magnetic concealed carry pocket system comprising:

a concealed carry pocket coupled to a surface of an object for concealing a firearm;

a magnet pouch coupled to the surface of the object and at least partially covered by the concealed carry pocket; and a magnet sized to fit within the magnet pouch and rated to hold the firearm in position within the concealed carry pocket;

and wherein the magnet pouch comprises an elastic band for securing the magnet within the pouch.

2. The magnetic concealed carry pocket system of claim 1 wherein the magnet is rated to allow removal of the firearm from within the concealed carry pocket via a twisting motion including movement of the firearm in a first rotational direction and in a second rotational direction.

3. The magnetic concealed carry pocket system of claim 1 wherein the concealed carry pocket comprises a flap, the flap comprising at least one attached edge coupled to the surface of the object and at least one free edge that is movable between:

an open position in which at least a portion of the at least one free edge is separated from the surface of the object; and a closed position in which the at least one free edge is adjacent the surface of the object.

4. The magnetic concealed carry pocket system of claim 3 further comprising:

a first magnet coupled to or embedded in the at least one free edge of the flap of the concealed carry pocket; and a second magnet coupled to or embedded in the surface of the object and aligned with the first magnet when the at least one free edge of the flap is in the closed positioned;

wherein the first and second magnets are configured to magnetically couple to each other; and wherein the flap a is releasably held to the surface of the object when the first and second magnets are magnetically coupled to each other.

5. The magnetic concealed carry pocket system of claim 3 further comprising at least one releasable fastener coupling the at least one attached edge of the flap to the surface of the object.

6. The magnetic concealed carry pocket system of claim 1 further comprising a break plate coupled to the magnet via a hinge, the break plate configured to aid in de-coupling the firearm from the magnet.

7. The magnetic concealed carry pocket system of claim 1 wherein the magnet is an adjustable magnet system with an adjustable holding force.

8. The magnetic concealed carry pocket system of claim 1 further comprising a magnetic shield positioned adjacent a surface of the magnet opposite from a firearm holding surface of the magnet to redirect at least a portion of the magnetic field of the magnet.

9. A kit for a magnetic concealed carry pocket system, the kit comprising:

a magnet configured to hold the weight of a firearm when the firearm is magnetically coupled to the magnet;

a break plate couplable to the magnet and configured to aid in de-coupling the firearm from the magnet;

a magnet pouch sized to hold the magnet therein; and a concealed carry pocket sized to cover the magnet pouch and the firearm.

10. The kit of claim 9 wherein the concealed carry pocket comprises a liner and a flap; and wherein the flap includes at least one attached edge that is coupled to the liner and at least one free edge that movable away from and toward the liner.

11. The kit of claim 9 further comprising:

a first magnetic strip couplable to a surface of an object; and a second magnetic strip couplable to or embedded in the concealed carry pocket;

wherein the first and second magnetic strips are configured to magnetically couple to each other.

12. The kit of claim 9 wherein the magnet pouch comprises an elastic band configured to secure the magnet within the magnet pouch.

13. The kit of claim 9 wherein the magnet is an adjustable magnet system with an adjustable holding force.

14. The kit of claim 9 further comprising a magnetic shield configured to be positioned adjacent the magnet to redirect at least a portion of the magnetic field of the magnet.

15. The kit of claim 9 wherein the magnet is configured to secure the firearm within the concealed carry pocket and allow intentional removal of the firearm from the magnet via a dual-rotational motion.

16. A magnetic concealed carry pocket system comprising:

a magnet having a holding force sufficient to attract and hold a firearm against a firearm holding surface thereof;

a magnet pouch sized for the magnet to fit therein, couplable to a surface of an object, and comprising at least one securing device for securing the magnet therein, the at least one securing device comprising an elastic band, a zipper, a button, a hook and loop fastener, a securing magnet, or a combination thereof;

a concealed carry pocket comprising a flap sized to cover at least a portion of the magnet pouch, the concealed carry pocket couplable to the surface of the object; and a magnetic shield configured to be positioned adjacent a surface of the magnet opposite from the firearm holding surface of the magnet to redirect at least a portion of the magnetic field of the magnet.

17. The magnetic concealed carry pocket system of claim 16 further comprising a closure system for releasably holding the flap of the concealed carry pocket against the surface of the object.

18. The magnetic concealed carry pocket system of claim 16 further comprising a break plate coupled to the magnet via a hinge;

wherein a tab extends from an end of the break plate for separating the break plate from the magnet.

19. The magnetic concealed carry pocket system of claim 16 wherein the magnet is configured to permit the firearm to be removed by an intentional twisting motion including movement in two rotational directions.

20. The magnetic concealed carry pocket system of claim 16 wherein the magnet is an adjustable magnet system configured to allow a user to adjust the holding force of the magnet.

* * * * *